US011349198B2

(12) United States Patent
Chen et al.

(10) Patent No.: US 11,349,198 B2
(45) Date of Patent: May 31, 2022

(54) ANTENNA STRUCTURE

(71) Applicant: Shenzhen Next Generation Communications Limited, Shenzhen (CN)

(72) Inventors: Jia Chen, Shenzhen (CN); Kuo-Cheng Chen, New Taipei (TW); Jian-Wei Chang, New Taipei (TW); Zhen-Chang Tang, Shenzhen (CN); Yi-Ling Jiang, Shenzhen (CN); Wei-Yu Ye, Shenzhen (CN); Bo Peng, Shenzhen (CN); Chun-Sheng Wu, New Taipei (TW)

(73) Assignee: Mobile Drive Netherlands B.V., Amsterdam (NL)

( * ) Notice: Subject to any disclaimer, the term of this patent is extended or adjusted under 35 U.S.C. 154(b) by 103 days.

(21) Appl. No.: 16/654,872

(22) Filed: Oct. 16, 2019

(65) Prior Publication Data

US 2020/0136235 A1 Apr. 30, 2020

(30) Foreign Application Priority Data

Oct. 24, 2018 (CN) ..... 201811244525.4

(51) Int. Cl.

| | |
|---|---|
| ***H01Q 1/24*** | (2006.01) |
| ***H01Q 13/10*** | (2006.01) |
| ***H01Q 9/04*** | (2006.01) |
| ***H01Q 1/36*** | (2006.01) |
| ***H01Q 9/30*** | (2006.01) |
| *H01Q 5/371* | (2015.01) |

(52) U.S. Cl.

CPC ..... *H01Q 1/243* (2013.01); *H01Q 1/36* (2013.01); *H01Q 9/0442* (2013.01); *H01Q 9/30* (2013.01); *H01Q 13/10* (2013.01); *H01Q 5/371* (2015.01)

(58) Field of Classification Search

CPC ..... H01Q 1/243; H01Q 13/18

See application file for complete search history.

(56) References Cited

U.S. PATENT DOCUMENTS

| | | | | |
|---|---|---|---|---|
| 2011/0241948 | A1* | 10/2011 | Bevelacqua | H01Q 5/378 343/702 |
| 2017/0250475 | A1 | 8/2017 | Liu | |
| 2018/0026341 | A1* | 1/2018 | Mow | H04B 10/90 343/702 |
| 2018/0062245 | A1 | 3/2018 | Wu et al. | |
| 2018/0294576 | A1* | 10/2018 | Niakan | H01Q 13/103 |
| 2019/0267699 | A1* | 8/2019 | Kim | G06F 1/1698 |
| 2019/0393586 | A1* | 12/2019 | Ayala Vazquez | H01Q 9/42 |

FOREIGN PATENT DOCUMENTS

| | | |
|---|---|---|
| CN | 207559049 U | 6/2018 |
| CN | 108376830 | 8/2018 |
| TW | 201813189 A1 | 4/2018 |
| TW | 201830772 A | 8/2018 |

* cited by examiner

*Primary Examiner* — Ricardo I Magallanes

(74) *Attorney, Agent, or Firm* — ScienBiziP, P.C.

(57) ABSTRACT

An antenna structure applied in a wireless communication device includes a metal frame. The wireless communication device includes at least one electronic component. The metal frame includes a substrate. The substrate includes an antenna. The antenna includes a feed portion and a gap. The feed portion spans the gap. The metal frame is spaced from the electronic component. A clearance is formed between the metal frame and the electronic component.

20 Claims, 7 Drawing Sheets

ANTENNA STRUCTURE

FIELD

The subject matter herein generally relates to antenna structures, and more particularly to an antenna structure of a wireless communication device.

BACKGROUND

With the advancement of wireless communication technology, consumers have higher and higher requirements for the bandwidth of wireless communication products. Generally, upper and lower ends of a metal frame of a wireless communication device are used as an antenna. The metal frame is divided into several segments by setting a plurality of gaps in the metal frame for implementing antennas with different functions (for example, 4G, Global Positioning System (GPS), and Wireless LAN (WLAN).

5G communication can add new communication frequency bands, but the antenna space is already very crowded. If 5G antennas are added to the antenna space, the performance of the other antennas may be affected, and a flexibility of antenna design may be reduced.

BRIEF DESCRIPTION OF THE DRAWINGS

Implementations of the present disclosure will now be described, by way of embodiments only, with reference to the attached figures.

DETAILED DESCRIPTION

Figure 1:
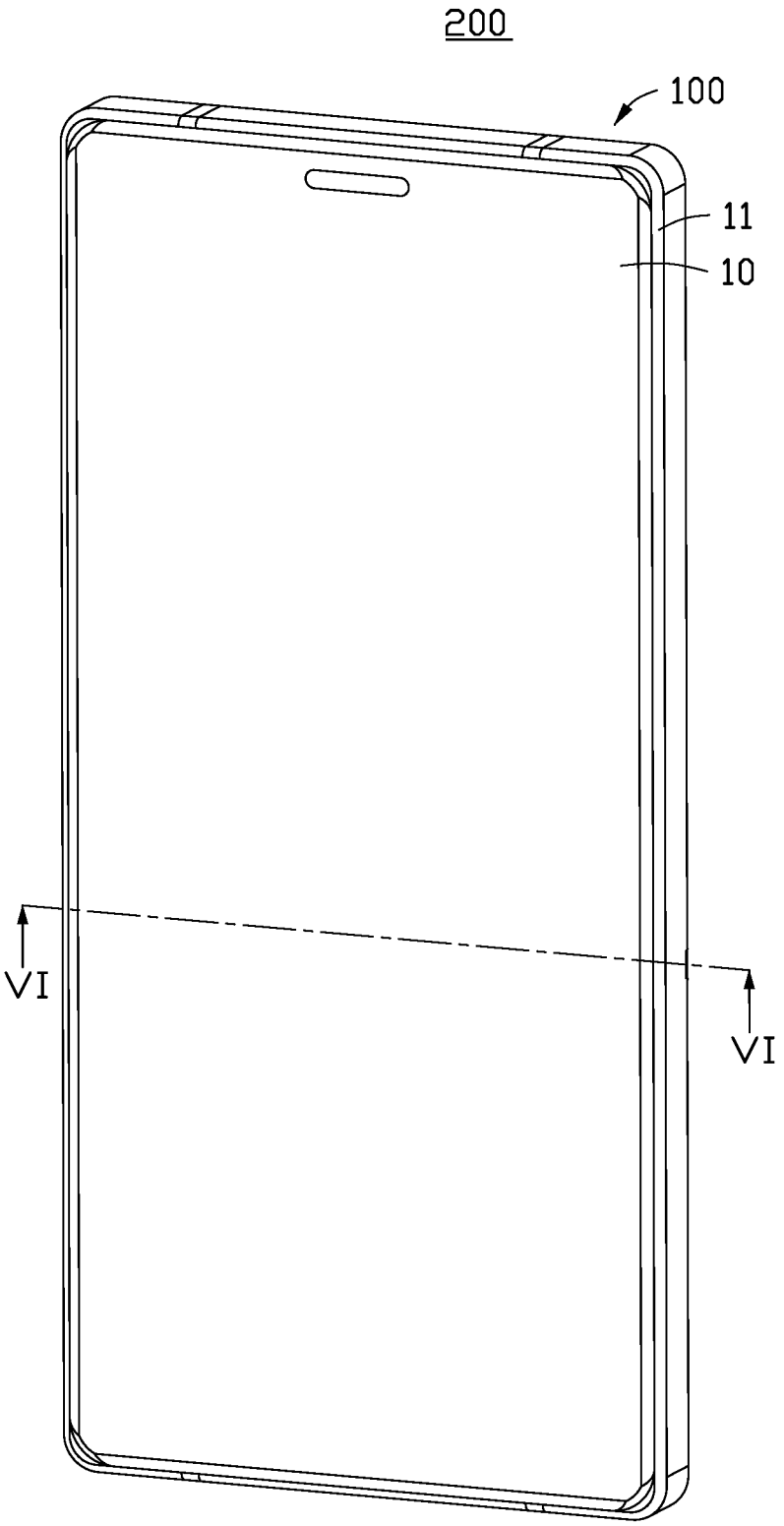
FIG. 1 is an isometric view of an embodiment of a wireless communication device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 2:
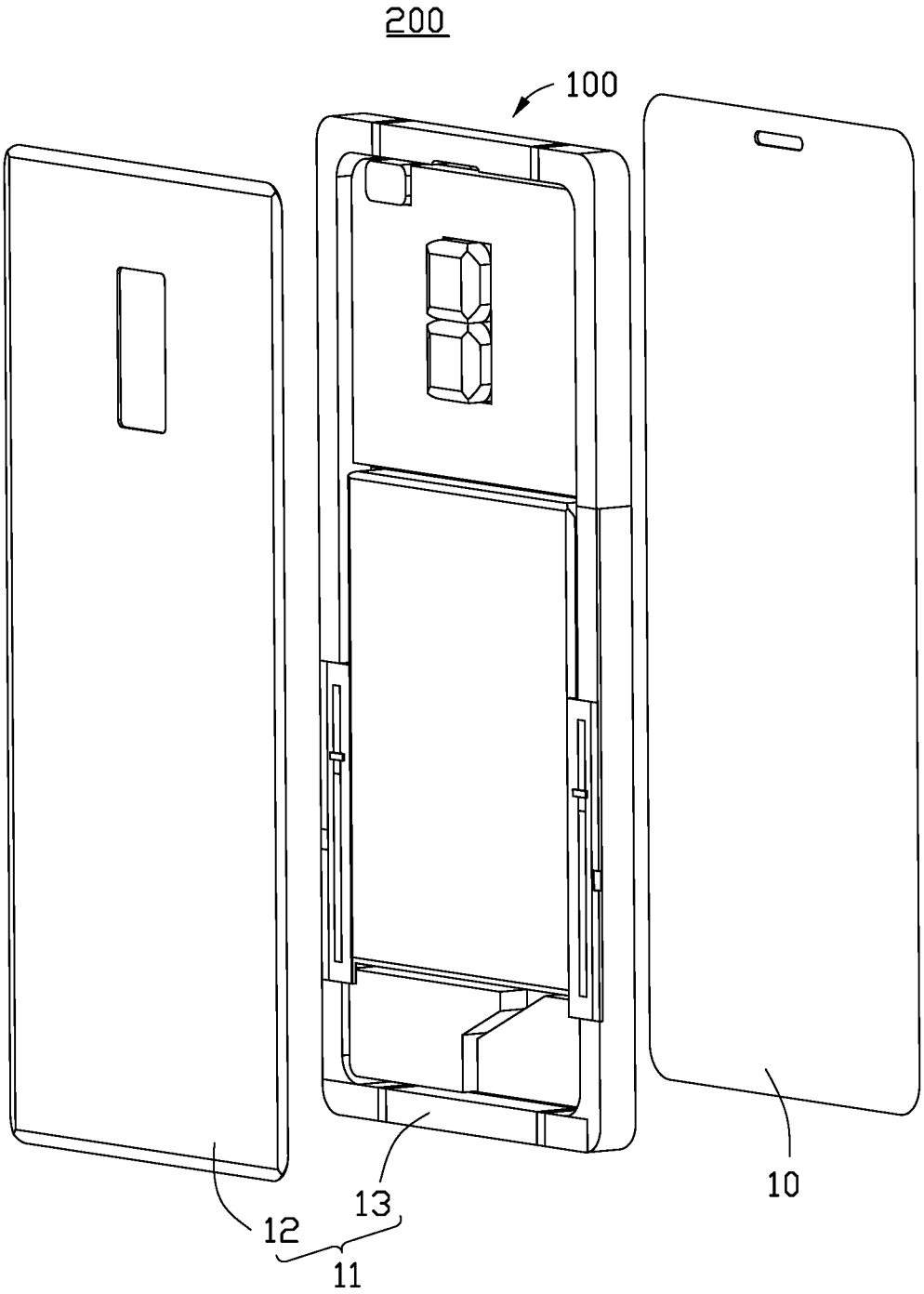
FIG. 2 is a partial exploded view of the wireless communication device in FIG. 1 including an antenna structure.

FIGS. 1-2 show an embodiment of an antenna structure 100 applicable in a mobile phone, a personal digital assistant, or other wireless communication device 200 for sending and receiving wireless signals.

The wireless communication device 200 includes a housing 11. The housing 11 can be an outer casing of the wireless communication device 200. The housing 11 includes a backplane 12 and a metal frame 13. In one embodiment, the backplane 12 is made of a non-metallic material such as plastic, glass or ceramic. The metal frame 13 is made of a metal material, and the metal frame 13 may be an outer frame of the wireless communication device 200. The backplane 12 and the metal frame 13 form an outer casing of the wireless communication device 200. The wireless communication device 200 also includes a display screen 10. In one embodiment, the display screen 10 can be a touch display screen, which can be used to provide an interactive interface to implement user interaction with the wireless communication device 200. The display screen 10 is substantially parallel to the backplane 12.

Figure 3:
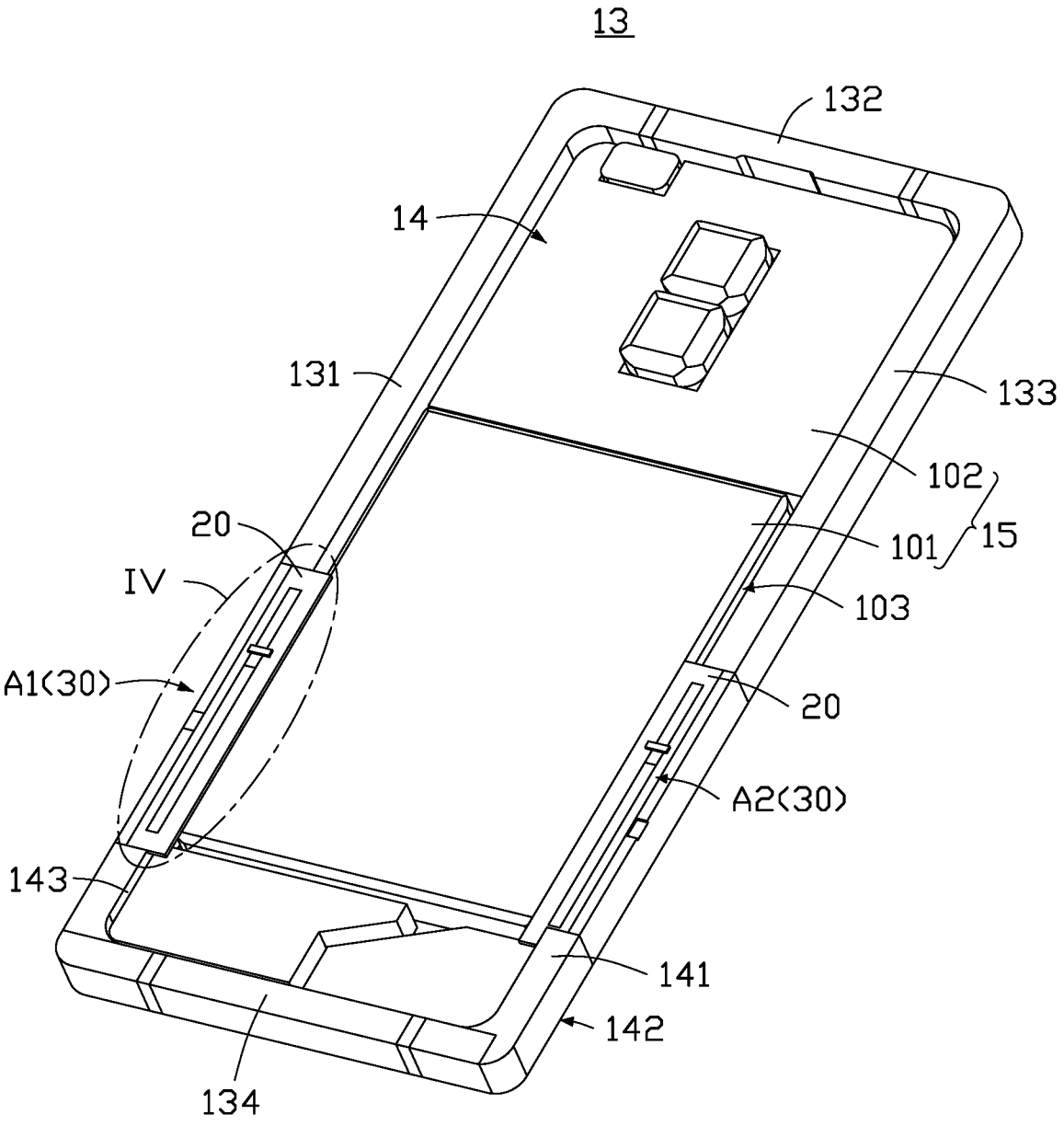
FIG. 3 is an isometric view of a metal frame of the antenna structure in FIG. 2.
Figure 4:
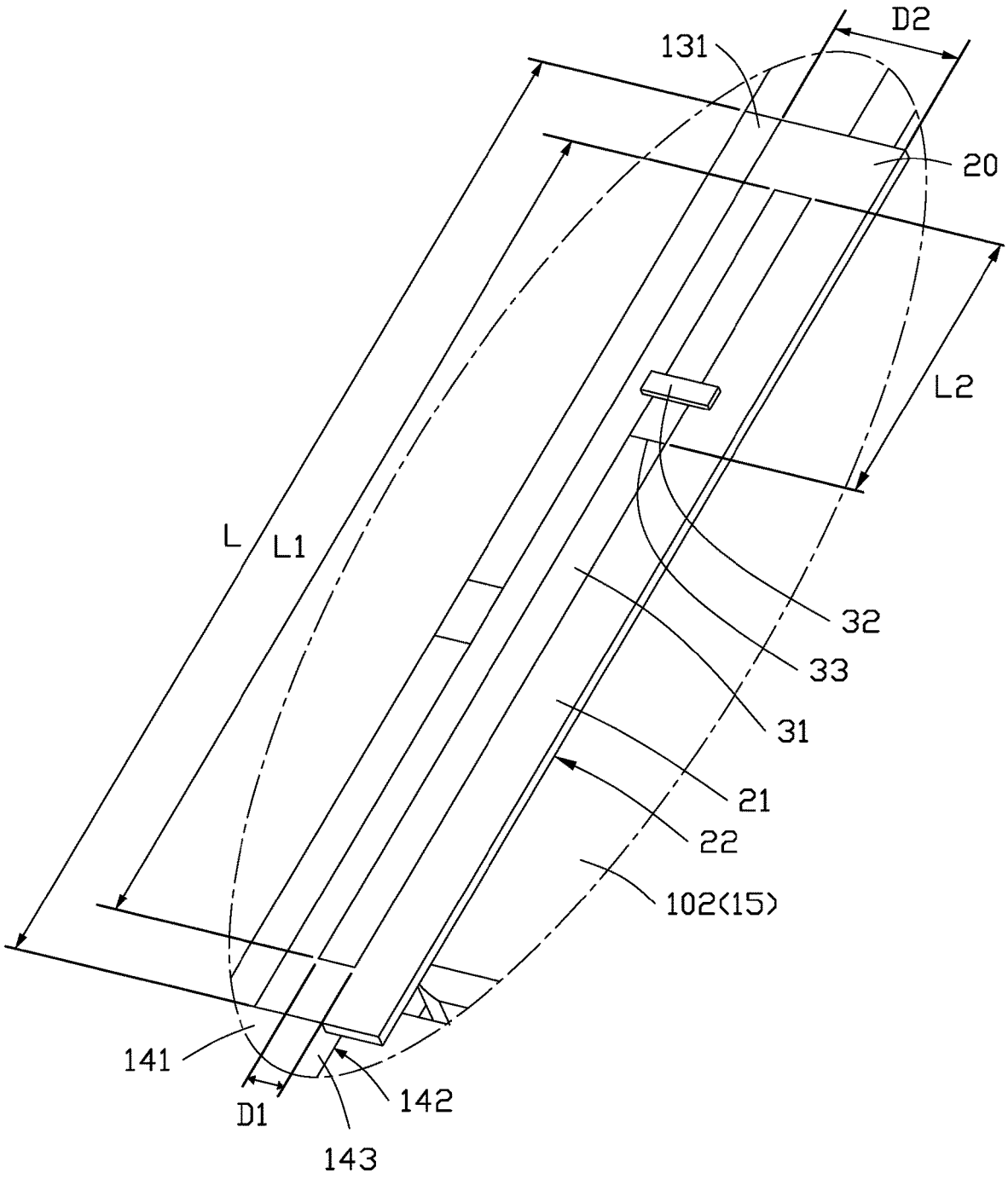
FIG. 4 is a close-up view of a circled portion IV in FIG. 3.

As shown in FIG. 3 and FIG. 4, the metal frame 13 is substantially an annular structure. In one embodiment, the metal frame 13 and the backplane 12 enclose an accommodating space 14. The accommodating space 14 is configured to receive circuit modules such as a battery 101, a main board 102, and a processing unit of the wireless communication device 200.

In one embodiment, the battery 101 is spaced from a sidewall of the metal frame 13 to define a clearance 103 of the antenna structure 100. The main board 102 can be a Printed Circuit Board.

In one embodiment, the metal frame 13 includes a first side portion 131, a second side portion 132, a third side portion 133, and a fourth side portion 134 coupled together in sequence. In one embodiment, the first side portion 131 is opposite to the third side portion 133. The second side portion 132 is opposite to the fourth side portion 134. The second side portion 132 is coupled substantially perpendicularly between the first side portion 131 and the third side portion 133. The fourth side portion 134 is coupled substantially perpendicularly between the first side portion 131 and the third side portion 133. In one embodiment, the second side portion 132 is defined as a top end of the wireless communication device 200, and the fourth side portion 134 is defined as a bottom end of the wireless communication device 200.

In one embodiment, the metal frame 13 includes a first side 141, a second side 142, and a third side 143. The first side 141 and the second side 142 are oppositely arranged. That is, the first side portion 131, the second side portion 132, the third side portion 133, and the fourth side portion 134 each include the first side 141, the second side 142, and the third side 143. The third side 143 is coupled between the first side 141 and the second side 142. The first side 141 is perpendicularly coupled to the third side 143, and the second side 142 is perpendicularly coupled to the third side 143. The first side 141 is parallel to and spaced from the second side 142. In other embodiments, the third side 143 is coupled to the first side 141 and the second surface 142 at a different angle.

In one embodiment, the first side 141 faces the backplane 12, and the second side 142 faces the display screen 10. The third side 143 faces an inner side of the metal frame 13, such as the battery 101.

In one embodiment, at least one substrate 20 is mounted on the metal frame 13. The substrate 20 may be a flexible printed circuit board. In one embodiment, the substrate 20 may be entirely made of metal or partially made of metal. The substrate 20 is mounted on an electronic component 15 and the metal frame 13. In one embodiment, the substrate 20 is mounted on the battery 101 and the metal frame 13. One side of the substrate 20 is mounted on the battery 101, and a second side of the substrate 20 is mounted on the metal frame 13. That is, the substrate 20 is mounted (suggest "bridges across") above the clearance 103.

Figure 5:
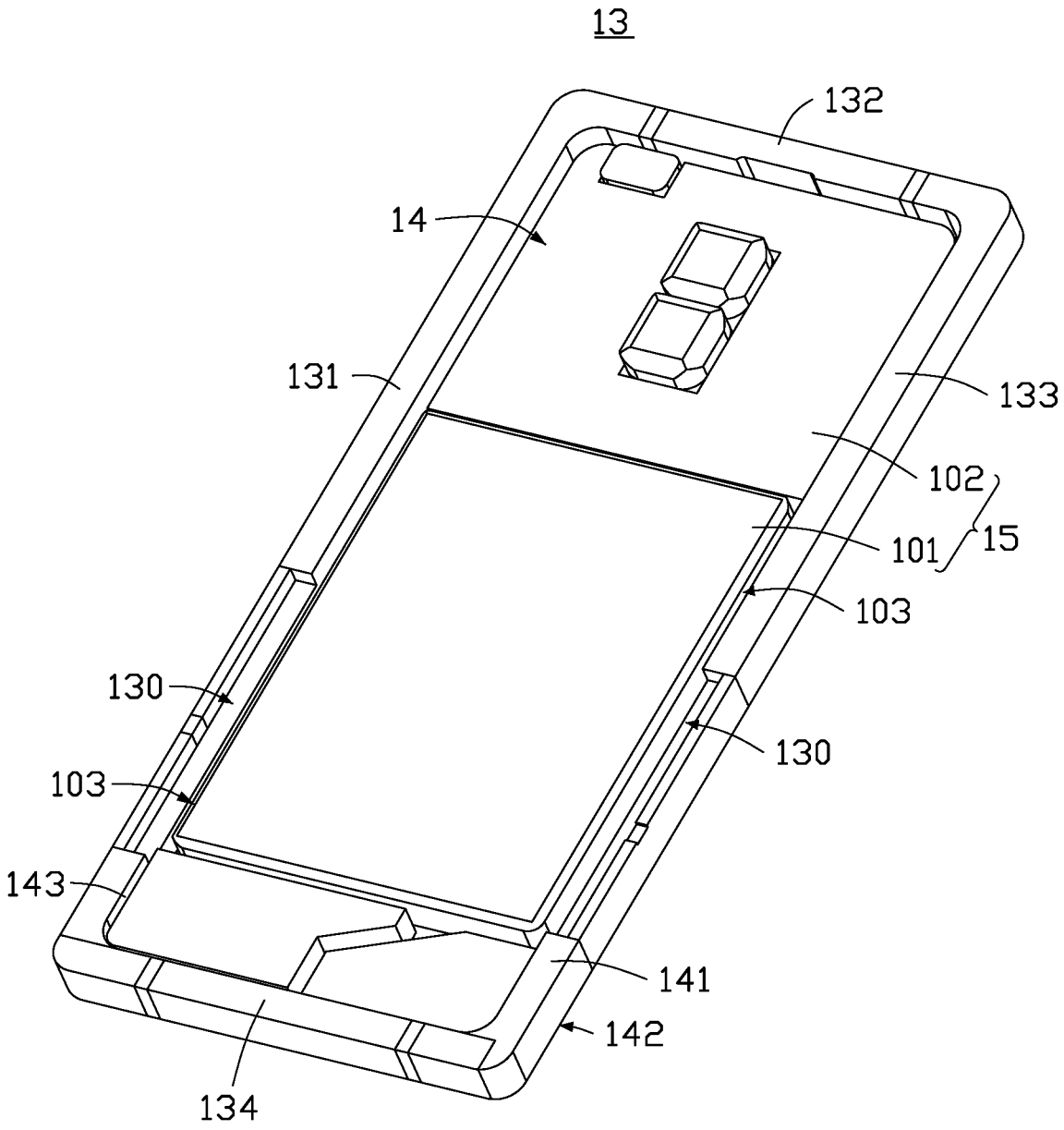
FIG. 5 is similar to FIG. 3, but having two antennas removed.
Figure 6:
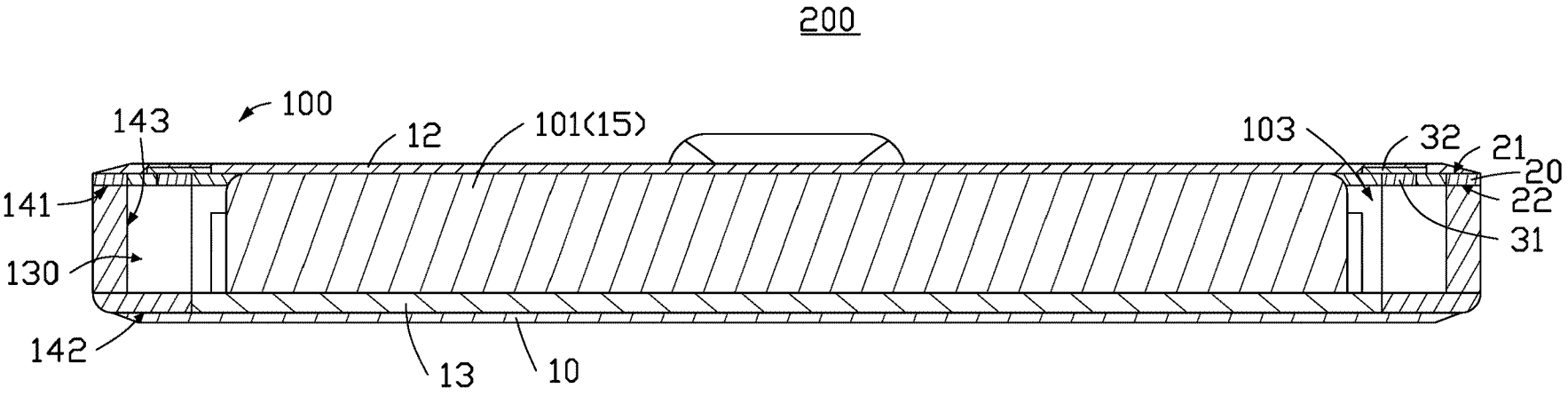
FIG. 6 is a cross-sectional view taken along line VI-VI in FIG. 1.

As shown in FIG. 5 and FIG. 6, in one embodiment, at least one slot 130 is defined in the metal frame 13. The slot 130 is elongated in shape. A quantity of the slot 130 is the same as a quantity of the substrate 20, and the slot 130 is defined below the substrate 20. The slot 130 expands the clearance 103. A space between the battery 101 and the third side 143 of the metal frame 13 is part of the clearance 103 of the antenna structure 100. The slot 130 forms part of the clearance 103. There are no conductors or electronic components in the clearance 103. In other embodiments, when the distance between the third side 143 and the battery 101 is sufficiently large, the slot 130 may be omitted. (only described 1 side. Are the structure symmetric? How about the first side 141?)

In one embodiment, the at least one slot 130 can be formed on the metal frame 13 by a CNC numerical control processing method. In other embodiments, the metal frame 13 may be cut by other processing methods such as laser cutting technology, so that the at least one slot 130 is formed on the metal frame 13.

In one embodiment, the substrate 20 includes a first surface 21 and a second surface 22. The second surface 22 is opposite the first surface 21. The first surface 21 and the first side 141 are located on a same plane. The first surface 21 faces the backplane 12. The second surface 22 faces away from the first side 141 and faces the second side 142 and the display screen 10.

In other embodiments, the substrate 20 may be arranged at other locations of the metal frame 13. In another embodiment, the first surface 21 and the second side 142 are located on a same plane, such that the first surface 21 faces the display screen 10, and the second surface 22 faces away from the second side 142 and faces the first side 141 and the backplane 12.

An antenna 30 is formed on the at least one substrate 20. In one embodiment, two substrates 20 are mounted on the metal frame 13. A first substrate 20 is mounted on the first side portion 131 and the battery 101, and a second substrate 20 is mounted on the third side portion 133 and the battery 101. Thus, a first antenna A1 and a second antenna A2 are respectively disposed on the two substrates 20. The first antenna A1 and the second antenna A2 have a similar structure. The first antenna A1 and the second antenna A2 are oppositely arranged. In one embodiment, the first antenna A1 and the second antenna A2 may form a multiple-input multiple-output (MIMO) antenna for providing 2×2 multiple input and multiple output.

In other embodiments, the two substrates 20 are not limited to the above configuration, and may be mounted on at least one of the first side portion 131, the second side portion 132, the third side portion 133, the fourth side portion 134, or a combination thereof. That is, the antenna 30 may not be disposed on each of the first side portion 131, the second side portion 132, the third side portion 133, and the fourth side portion 134, and one or more antennas 30 may be disposed on some or all of the first side portion 131, the second side portion 132, the third side portion 133, and the fourth side portion 134.

A quantity of the substrates 20 mounted on the metal frame 13 is not limited to two, and may be one or any number. Correspondingly, a quantity of the antennas 30 is not limited to two, and may be one or any number.

The configuration of the antenna 30 will be described by taking one of the antennas 30, such as the first antenna A1.

Each of the antennas 30 includes a gap 31 and a feed portion 32. The gap 31 and the feed portion 32 are both elongated in shape. The gap 31 is defined in the substrate 20. The gap 31 passes through the first surface 21 and the second surface 22. The feed portion 32 is mounted on the first surface 21 and spans the gap 31. A length L1 of the gap 31 is smaller than a length L of the substrate 20. A width D1 of the gap 31 is smaller than a width D2 of the substrate 20.

The substrate 20 may be all metal or a layer of metal formed around the gap 31. The gap 31 may be filled with an insulating material or may not be filled with an insulating material. The feed portion 32 can be a wire or a metal segment of the flexible printed circuit board.

In one embodiment, each of the antennas 30 further includes at least one switch 33. Two ends of the switch 33 are respectively coupled to two sides of the substrate 20 across the gap 31, and the switch 33 selectively switches on and off to adjust the length L1 of the gap 31, thereby adjusting a resonance frequency of the antenna structure 100. When the switch 33 switches off, the switch 33 does not affect the length L1 of the gap 31. When the switch 33 switches on, the switch 33 shortens the length L1 of the gap 31 to adjust the resonance frequency of the antenna structure 100. When the switch 33 switches on, the gap 31 is divided into two segments. At this time, the length of the gap 31 is shortened to a length L2 of the segment including the feed portion 32. L2 is less than L1.

Each of the antennas 30 is a slot antenna. When the feed portion 32 supplies an electric current, the electric current from the feed portion 32 is coupled to the gap 31, so that the substrate 20 can excite a first resonance mode and a second resonance mode under control of the switch 33 and generate a radiation signal in a first frequency band and a second frequency band, respectively. When the switch 33 switches on, the length of the gap 31 is L2, and the electric current is coupled to the gap 31, so that the substrate 20 excites the first resonance mode and generates a radiation signal in the first frequency band. When the switch 33 switches off, the length of the gap 31 is L1, and the electric current is coupled to the gap 31, so that the substrate 20 excites the second resonance mode to generate a radiation signal in the second frequency band.

In one embodiment, the first resonance mode and the second resonance mode are both 5G sub-6 GHz modes. The second frequency band is lower than the first frequency band. The first frequency band is 4.8 to 5.0 GHz, and the second frequency band is 3.3 to 3.6 GHz.

In other embodiments, the first resonance mode and the second resonance mode may be WIFI modes. In one embodiment, the first resonance mode is a WIFI 5 GHz mode, and the second resonance mode is a WIFI 2.4 GHz mode.

In one embodiment, each of the antennas 30 includes an N number of switches 33. By controlling the N number of switches 33 to switch on and switch off, the length L1 of the gap 31 can be changed by N+1, so that the antenna structure 100 can cover N+1 resonance frequency bands. N is any positive integer. When an electric current is supplied from the feed portion 32, the electric current is coupled to the gap 31, so that the substrate 20 can excite N+1 resonance modes under the action of the N switches 33 and generate a radiation signal in an N+1 number of frequency bands.

Figure 7:
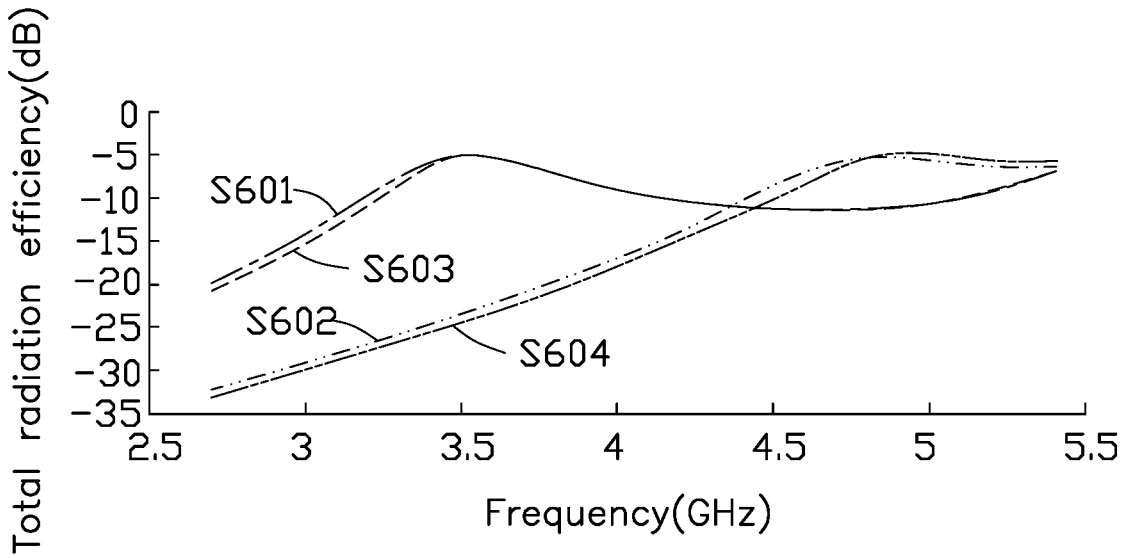
FIG. 7 is a graph of total radiation efficiency of the antenna structure.

FIG. 7 shows a graph of total radiation efficiency of the antenna structure 100. A plotline S601 is a total radiation efficiency of the first antenna A1 operating in the 3.5 GHz band. A plotline S602 is a total radiation efficiency of the first antenna A1 operating in the 5 GHz band. A plotline S603 is a total radiation efficiency of the second antenna A2 operating in the 3.5 GHz band. A plotline S604 is a total radiation efficiency of the second antenna A2 operating in the 5 GHz band.

As shown in FIG. 7, the total radiation efficiency of the first antenna A1 operating in the 3.5 GHz band and the total radiation efficiency of the second antenna A2 operating in the 3.5 GHz band substantially overlap, and the total radiation efficiency of the first antenna A1 operating in the 5 GHz band and the total radiation efficiency of the second antenna A2 operating in the 5 GHz band substantially overlap. The total radiation efficiency of a plurality of the antennas 30 disposed on opposite sides of the metal frame 13 when operating in the same frequency band is substantially the same.

As described in the foregoing embodiments, the antenna structure 100 is provided with at least one substrate 20 on the metal frame 13. Each of the antennas 30 includes a gap 31, a feed portion 32, and at least one switch 33. The gap 31 passes through the first surface 21 and the second surface 22 of the substrate 20. The feed portion 32 spans the gap 31 and supplies an electric current to the gap 31 in a coupled manner, so that the substrate 20 excites the first resonance mode and the second resonance mode under the control of the switch 33 and generate radiation signals in the 3.3-3.6 GHz band and the 4.8-5.0 GHz band. One or more of the first side portion 131, the second side portion 132, the third side portion 133, and the fourth side portion 134 of the metal frame 13 may be used to mount the substrate 20, and the remaining side portions may be used for mounting other antennas such as 4G, Global Positioning System (GPS), and Wireless Local Area Network (WLAN) antennas. Therefore, the wireless communication device 200 can increase the transmission bandwidth by adding a 5G sub-6 GHz antenna or a WIFI antenna while maintaining performance of the other antennas.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure applied in a wireless communication device comprising an electronic component, the antenna structure comprising:

a metal frame spaced from the electronic component and a clearance formed between the metal frame and the electronic component, the metal frame defining at least one slot; and a substrate on the metal frame and comprising an antenna, the substrate mounted on the at least one slot and the electronic component, the substrate arranged over the at least one slot, a first side of the substrate contacting the electronic component, and a second side of the substrate contacting the metal frame, the first side and the second side of the substrate respectively arranged on opposite sides of the at least one slot;

wherein the antenna comprises a gap, a feed portion, and a switch, the gap is defined on and extends through the substrate, the feed portion spans over the gap, and wherein two ends of the switch are respectively coupled to two sides of the gap, the switch selectively switches on and off to adjust a length of the gap to adjust a resonance frequency of the antenna structure.

2. The antenna structure of claim 1, wherein the substrate is mounted on the electronic component and the metal frame.

3. The antenna structure of claim 1, wherein:

the substrate comprises a first surface and a second surface;

the first surface is opposite to the second surface;

the gap passes through the first surface and the second surface.

4. The antenna structure of claim 1, wherein:

when the switch switches on, the gap is divided into two sections, and the length of the gap is shortened to a length of the section containing the feed portion;

when the switch switches off, the length of the gap is substantially unchanged.

5. The antenna structure of claim 4, wherein:

the feed portion is mounted on the first surface;

when the feed portion supplies an electric current, the electric current from the feed portion is coupled to the gap;

when the switch switches on, the length of the gap is shortened to excite a first resonance mode and generate a radiation signal in a first frequency band;

when the switch switches off, the length of the gap is substantially unchanged to excite a second resonance mode and generate a radiation signal in a second frequency band;

the second frequency band is lower than the first frequency band.

6. The antenna structure of claim 3, wherein:

the metal frame comprises a first side, a second side, and a third side;

the third side is coupled between the first side and the second side;

the first side is perpendicularly coupled to the third side;

the second side is perpendicularly coupled to the third side;

the first side is parallel to and spaced from the third side;

the third side faces an inner side of the metal frame.

7. The antenna structure of claim 6, wherein:

the first surface and the first side are arranged on a same plane;

the second surface faces away from the first side and faces the second surface.

8. The antenna structure of claim 6, wherein:

the first surface and the second side are arranged on a same plane;

the second surface faces the first surface away from the second side.

9. The antenna structure of claim 1, wherein the at least one slot is formed between the metal frame and the electronic component to expand the clearance.

10. A wireless communication device comprising an antenna structure, a backplane, a display screen, and an electronic component, the antenna structure comprising:

a metal frame spaced from the electronic component and a clearance formed between the metal frame and the electronic component, the metal frame defining at least one slot; and a substrate positioned on the metal frame and comprising an antenna, the substrate mounted on the at least one slot and the electronic component, the substrate arranged over the at least one slot, a first side of the substrate contacting the electronic component, and a second side of the substrate contacting the metal frame, the first side and the second side of the substrate respectively arranged on opposite sides of the at least one slot;

wherein the antenna comprises a gap, a feed portion, and a switch, the gap is defined on and extends through the substrate, the feed portion spans over the gap, and wherein two ends of the switch are respectively coupled to two sides of the gap, the switch selectively switches on and off to adjust a length of the gap to adjust a resonance frequency of the antenna structure.

11. The wireless communication device of claim 10, wherein the substrate is mounted on the electronic component and the metal frame.

12. The wireless communication device of claim 10, wherein:

the substrate comprises a first surface and a second surface;

the first surface is opposite to the second surface;

the gap passes through the first surface and the second surface.

13. The wireless communication device of claim 10, wherein:

when the switch switches on, the gap is divided into two sections, and the length of the gap is shortened to a length of the section containing the feed portion; and when the switch switches off, the length of the gap is substantially unchanged.

14. The wireless communication device of claim 13, wherein:

the feed portion is mounted on the first surface;

when the feed portion supplies an electric current, the electric current from the feed portion is coupled to the gap;

when the switch switches on, the length of the gap is shortened, to excite a first resonance mode and generate a radiation signal in a first frequency band;

when the switch switches off, the length of the gap is substantially unchanged to excite a second resonance mode and generate a radiation signal in a second frequency band;

the second frequency band is lower than the first frequency band.

15. The wireless communication device of claim 12, wherein:

the metal frame comprises a first side, a second side, and a third side;

the third side is coupled between the first side and the second side;

the first side is perpendicularly coupled to the third side;

the second side is perpendicularly coupled to the third side;

the first side is parallel to and spaced from the third side;

the third side faces an inner side of the metal frame.

16. The wireless communication device of claim 15, wherein:

the first surface and the first side are arranged on a same plane;

the second surface faces away from the first side and faces the second surface.

17. The wireless communication device of claim 15, wherein:

the first surface and the second side are arranged on a same plane;

the second surface faces the first surface away from the second side.

18. The wireless communication device of claim 10, wherein the at least one slot is formed between the metal frame and the electronic component to expand the clearance.

19. The antenna structure of claim 1, wherein the substrate is parallel to a back panel of the communication device.

20. The wireless communication device of claim 10, wherein the substrate is parallel to a back panel of the communication device.

* * * * *